US005809919A

United States Patent [19]

Mitchell et al.

[11] Patent Number: 5,809,919

[45] Date of Patent: Sep. 22, 1998

[54] CLAMPING DEVICE AND METHOD FOR AN AUTOMATIC SEWING SYSTEM

[75] Inventors: George Mitchell, Barneveld, N.Y.; Tadeusz Olewicz, Hoschton, Ga.; Ernst Schramayr, Barneveld, N.Y.

[73] Assignee: Jet Sew Technologies, Inc., Barneveld, N.Y.

[21] Appl. No.: 716,563

[22] Filed: Sep. 18, 1996

[51] Int. Cl.[6] ..... D05B 21/00

[52] U.S. Cl. ..... 112/470.07; 112/470.14; 112/475.08; 112/DIG. 2

[58] Field of Search ..... 112/47.07, 470.14, 112/470.06, 470.09, 470.16, 311, 320, 306, 153, 104, 113, 114, 475.06, 475.08, 475.01, DIG. 2, 141

[56] References Cited

U.S. PATENT DOCUMENTS

| | | | |
|---|---|---|---|
| 3,930,454 | 1/1976 | Perlino | 112/470.07 |
| 4,441,444 | 4/1984 | Jung . | |
| 4,601,249 | 7/1986 | Frye . | |
| 4,685,408 | 8/1987 | Frye . | |
| 4,841,887 | 6/1989 | Castillo | 112/470.07 |
| 4,928,610 | 5/1990 | Akutsu . | |
| 5,018,462 | 5/1991 | Brocklehurst . | |
| 5,065,684 | 11/1991 | Hansberry | 112/470.07 X |
| 5,189,967 | 3/1993 | Schips et al. . | |
| 5,299,515 | 4/1994 | Baba et al. . | |
| 5,483,908 | 1/1996 | Nolle . | |
| 5,493,978 | 2/1996 | Campolucci . | |

*Primary Examiner*—Peter Nerbun

[57] ABSTRACT

A stitching clamp for an automatic sewing sewing machine. The stitching clamp has a flexible membrane defining a track for the presser foot of a sewing head to maintain the presser foot in a spaced relationship with respect to a workpiece as the workpiece is moved through a sewing head by the combination of at least one feed dog and a servocontrol. The stitching clamp further includes a label clamp for securely holding a label against a workpiece.

26 Claims, 4 Drawing Sheets

CLAMPING DEVICE AND METHOD FOR AN AUTOMATIC SEWING SYSTEM

BACKGROUND OF THE INVENTION

The present invention relates to a clamping apparatus for an automatic sewing system including, but not limited to a clamping device for an automatic sewing system for overedge hemming about the perimeter of a washcloth.

In recent years, the textile industry has developed several fully automatic sewing systems designed to overedge hem about the perimeter of a workpiece, specifically including a washcloth. These systems are typically subdivided into several subsystems designed to perform specific tasks in the production of a washcloth.

One such subsystem includes a servo-driven gantry system equipped with a clamping device, commonly known as a stitching clamp, which is used to clamp and transport the cloth workpiece through a sewing subsystem having a sewing head.

In a conventional automated system, a workpiece is first straightened, lightly tensioned, and cut to length. At about the same time, if required, labels are positioned along one side of the edge of the workpiece prior to commencing the actual sewing operation. A stitching clamp then traps the workpiece (and the labels) between the clamp and a planar work surface. The workpiece and labels are then moved by the stitching clamp using a servocontrol to manipulate the washcloth with respect to the sewing head for producing the overedge hem.

The overedge hem is produced continuously on all four sides and on the four radius corners as the workpiece is moved by the servocontrol. The edge of the stitching clamp must be kept clear of the sewing head during the sewing operation so as not to interfere with the presser foot of the sewing head and associated parts. A portion of the workpiece not contained by the stitching clamp is engaged by the presser foot and the feed dogs of the sewing head which unidirectionally move the workpiece toward and through the sewing head in cooperation with the stitching clamp.

In order to produce a true and consistent shape in the finished workpiece, the speed of the stitching clamp must be precisely matched with the speed of the sewing head, so that the feed dogs pull the cloth under the presser foot at the same rate that the stitching clamp transports the cloth. The presser foot must exert sufficient pressure to eliminate flagging, while allowing the feed dogs to grab the cloth and pull it through with each stitch. The pressure exerted by the presser foot frequently creates friction between the cloth and the bottom of the presser foot which may adversely affect the shape and the consistency of the hem as shown in FIG. 5*a*. The potential for defects is especially prevalent at the corners of the workpiece, where the stitching clamp must make a circular motion with the workpiece while still under the presser foot as the feed dogs attempt to pull the workpiece through the sewing head stitch by stitch in a straight line motion.

The same pressure of the presser foot also tends to slide or push the labels between the cloth and the bottom of the presser foot causing the labels to shift in reference to the workpiece's edge. This creates a jagged or crooked edge and improperly attached labels on the final product.

SUMMARY OF THE INVENTION

Accordingly, it is a primary object of the present invention to provide an improved stitching clamp which eliminates friction between the cloth and the presser foot during stitch formation that overcomes the unpredictable and undesirably results associated with conventional stitching clamps.

A further object of the present invention is to provide an apparatus and method to control the leading edge of a workpiece prior to commencing a hemming process for eliminating irregularly shaped hems.

It is a further object of the present invention to provide an apparatus and method having a clamping device for insuring properly attached labels.

It is a further object of the present invention provide an apparatus and method having a stitching clamp to insure that the leading edge of the workpiece is properly positioned against the supporting surface of a work table prior to being moved through a sewing head.

These and other objects of the present invention are fulfilled by providing a method and apparatus with a stitching clamp for securely holding a workpiece of a fixed planar dimension on the supporting surface of a work table and for carrying the workpiece through the sewing head of a sewing machine using a presser foot having at least one needle and at least one feed dog. The stitching clamp includes the following. A top plate with first and second sides having an outer edge comparatively less than the outer edge of a workpiece to be sewn. The second side of the top plate being directed toward the supporting surface of a work table onto which is attached a flexible membrane which holds the workpiece against the work surface as it moves through the sewing head. The flexible membrane has an outer edge less than the outer edge of the workpiece but greater than the outer edge of the top plate such that a predetermined portion of the flexible membrane extends beyond the top plate and partially between the presser foot and the workpiece. This extended portion of the flexible membrane maintains the presser foot in a spaced relationship from the workpiece as it advances through the sewing head. The flexible membrane is sufficiently pliable to allow the presser foot to maintain pressure against the workpiece by extending force through the membrane to hold the workpiece against the supporting surface of the work table. At the same time, the flexible membrane has a friction resistant surface which allows the presser foot to easily travel along the upper surface of the flexible membrane as the at least one feed dog advances the material with the clamping means through the sewing head during the hemming process.

Further scope of applicability of the present invention will become apparent from the detailed description given hereinafter. However, it should be understood that the detailed description as specific examples, while indicating preferred embodiments of the invention, are given by way of illustration only, since various changes in modifications within the spirit and scope of the invention will become apparent to those skilled in the art from this detailed description.

BRIEF DESCRIPTION OF THE DRAWINGS

The present invention will become more fully understood from the detailed description given hereinbelow in the accompanying drawings which are given by way of illustration only, and thus, are not limitative of the present invention and wherein.

DETAILED DESCRIPTION OF THE PREFERRED EMBODIMENTS

Figure 1:
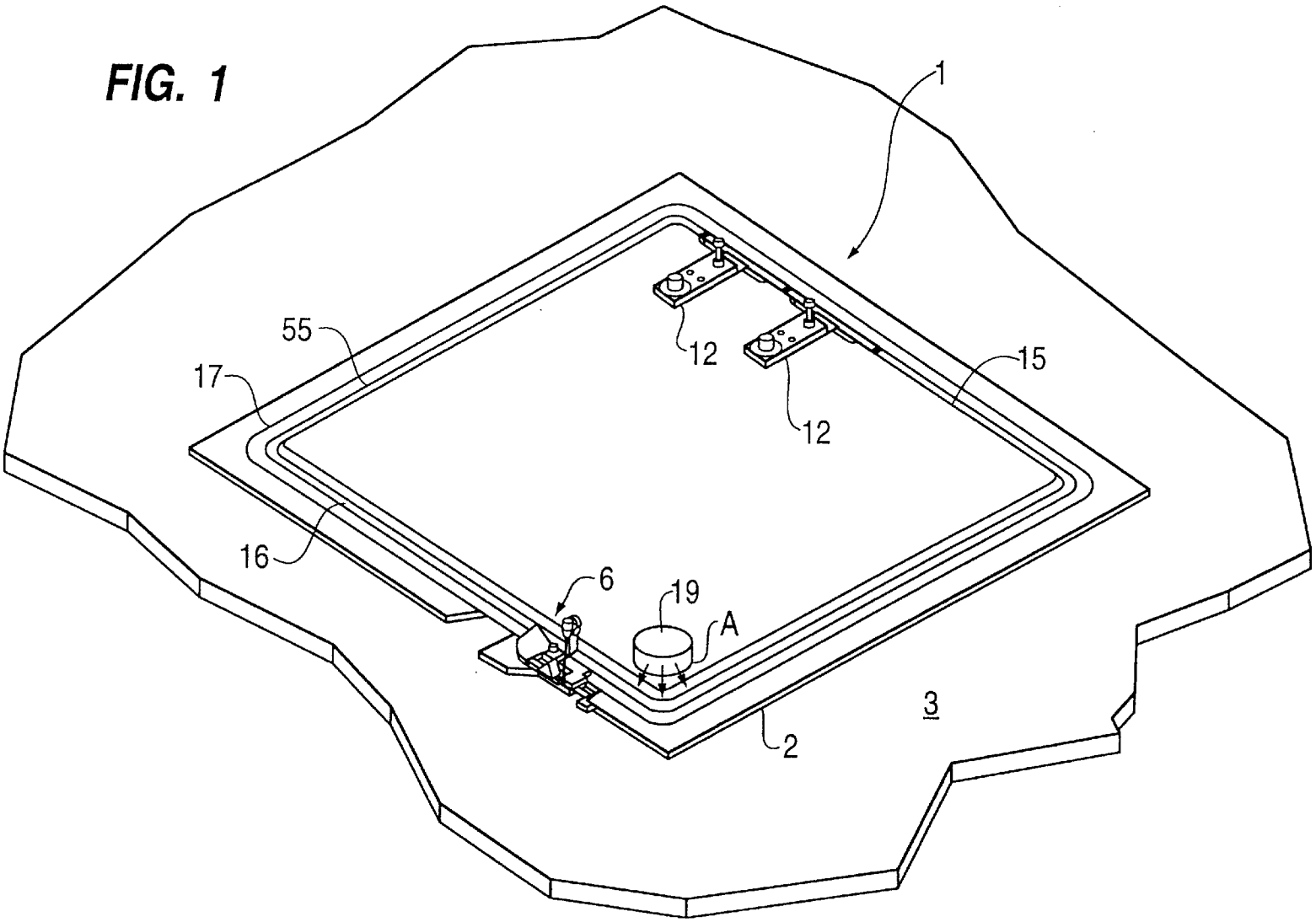
FIG. 1 is an isometric view of the stitching clamp assembly according to a preferred embodiment of the present invention with an enlarged view of a sewing head of an automatic sewing machine.

FIG. 1 shows a preferred embodiment of the stitching clamp assembly 1. The stitching clamp assembly has a top plate 15. The top plate 15 has a substantially square shape with rounded corners. The top plate may, however, be configured to accommodate other workpiece shapes and is not limited to a substantially square or rectangular configuration.

The top plate 15 has an outer perimeter that is comparatively less than the outer perimeter of a workpiece 2 to be sewn. A predetermined portion of the workpiece 2 extends outside the outer edge of the stitching clamp 1 for enabling the edge of the workpiece 2 to be folded and hemmed. The size of the top plate 15 is designed to allow the edge of the workpiece 2 to be moved through the sewing head without interference from the top plate 15 or any other constituent element of the stitching clamp assembly 1. The predetermined exposed edge partially defines a path on which the presser foot travels during the sewing operation as explained more fully hereinafter.

In the preferred embodiment the top plate 15 is a planar shaped member. Other forms for the top plate 15 may be used which provide for the exposed edge of the workpiece 2 without departing from the spirit of the invention. Further, the top plate 15 is made from a rigid material such as polished aluminum. However, other similar materials may be used.

The top plate 15 has a beveled edge 55 which extends about the outer perimeter of the element. The beveled edge 55 allows the top plate 15 to hold the workpiece 2 securely during the sewing operation by extending closely to, without interfering with, the sewing head.

A flexible membrane 17 is attached to the bottom surface of the top plate 15. The flexible membrane 17 has an outer perimeter comparatively greater than the outer perimeter of the top plate 15 but less than the outer perimeter of the workpiece 2. As discussed more fully below, the exposed edge of the flexible membrane 17 provides a partial support for the presser foot of the sewing head as the workpiece is being hemmed by the automatic sewing system.

Between the top plate 15 and flexible membrane 17 is an extension plate 16. The extension plate 16 has an outer perimeter which is slightly greater than the top plate 15 but less than the flexible membrane 17 and the workpiece 2. The extension plate 16 provides additional support for the flexible membrane 17 in clamping the workpiece securely against the supporting surface of the work table and for moving the workpiece through the sewing head.

Movement of the combination of the top plate 15, extension plate 16, and the flexible membrane 17 is controlled by a servocontrol system (not shown). The servocontrol system initially moves the stitching clamp assembly 1 into engagement with the workpiece for holding it against the supporting surface 3 of the worktable. Once engaged, the servocontrol is programmed to move the stitching clamp 1 in a predetermined path for transporting the workpiece 2 through the sewing head 6 in accomplishing the hemming operation.

Also shown in FIG. 1 is an air blower 19. The air blower 19 is strategically positioned close to one corner of the top plate 15. The air blower 19 directs air over the corner of the top plate 15 and toward the leading edge of the workpiece 2 prior to commencing the hemming operation. This uncurls or flattens the leading edge of the workpiece 2 against the supporting surface 3 of the work table. By performing this operation, the leading edge is not curled or bunched as it is hemmed by the sewing head 6.

In the preferred embodiment the air blower 19 causes a plurality of air currents A to be directed over two sides and the middle of one of the curved corners. The multi-direction air flow facilities the proper positioning of the workpiece 2 against the supporting surface 3.

An additional feature of the stitching clamp assembly 1, as shown in FIG. 1, is a pair of label clamp assemblies 12 for respectively holding a label against the workpiece 2 during the sewing operation. Specifics of the label clamp assemblies 12 are explained hereinafter with reference to FIG. 6.

Figure 2:
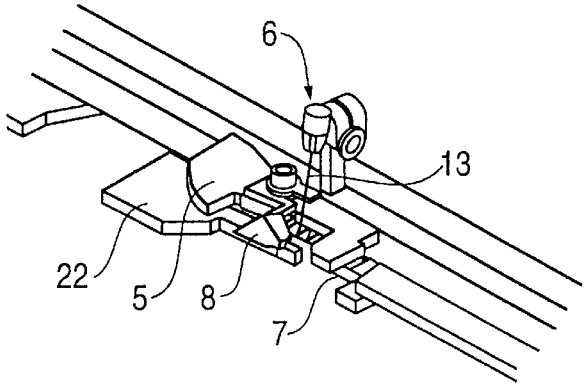
FIG. 2 is an enlarged partial top view of a corner of the stitching clamp assembly according to a preferred embodiment of the present invention.

FIG. 2 is an enlarged view of a sewing head 6 of an automatic sewing system as it engages the workpiece 2 and its general relationship to the clamping assembly 1. The illustrated sewing head 6 has a needle 13, needle plate 22, presser foot 5 and folder 8. The edge of the workpiece 2 is moved through the sewing head 6 by feed dogs 7 aligned with the sewing needle 13 and located underneath the presser foot 5. The feed dogs 7 are operated to grasp the workpiece 2 and linearly advance it stitch by stitch during the sewing operation. The workpiece 2 is placed in engagement with the feed dogs 7 using the presser foot 5 disposed directly above the workpiece 2 and in alignment with the feed dogs 7. A folder 8 makes a single fold in the edge of the workpiece 2 prior to it being stitched by the needle 13 as it is advanced by the combination of the stitch clamping assembly 1 and presser foot 5/feed dogs 7.

Figure 3:
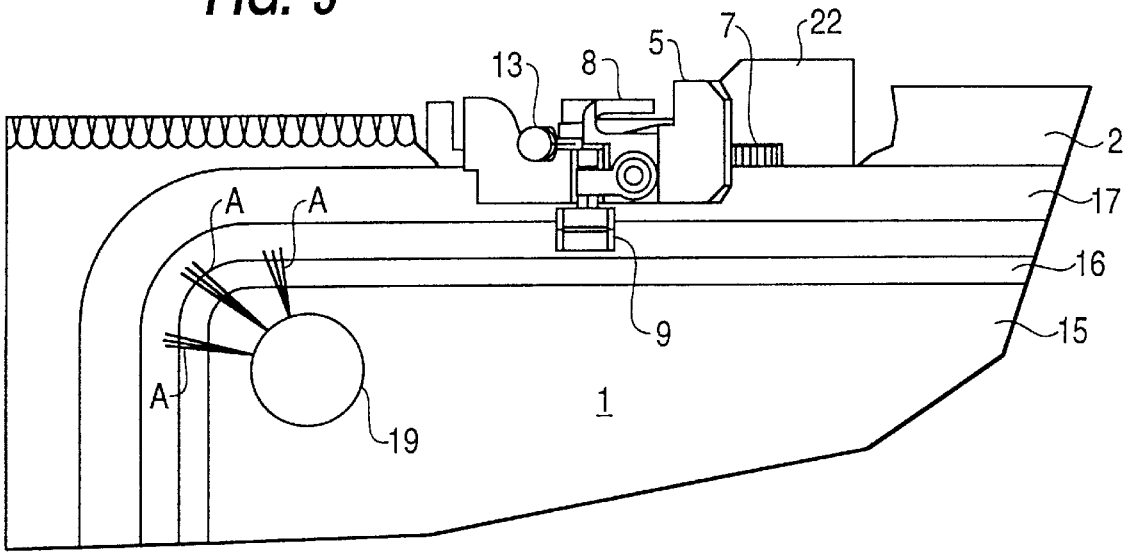
FIG. 3 is an enlarged partial sectional view of the stitching clamp assembly according to a preferred embodiment of the present invention.

FIG. 3 illustrates the relationship between the presser foot 5 and folder 8 as mounted to the presser foot bracket 9 and held in place by set plate 10 and screw 11. The stitching clamp assembly 1 carries the workpiece 2 over the needle plate 22 to the feed dogs 7. The feed dogs 7 pull the cloth under the presser foot 5, through the folder 8 and under the needle 13 producing the hem.

As also shown in FIG. 3, the blower 19 directs a plurality of air currents A toward a corner of the top plate 15, extension plate 16 and corner of the membrane 17 for flattening or uncurling the leading edge of the workpiece prior to the first corner of the workpiece entering the sewing head.

Figure 4:
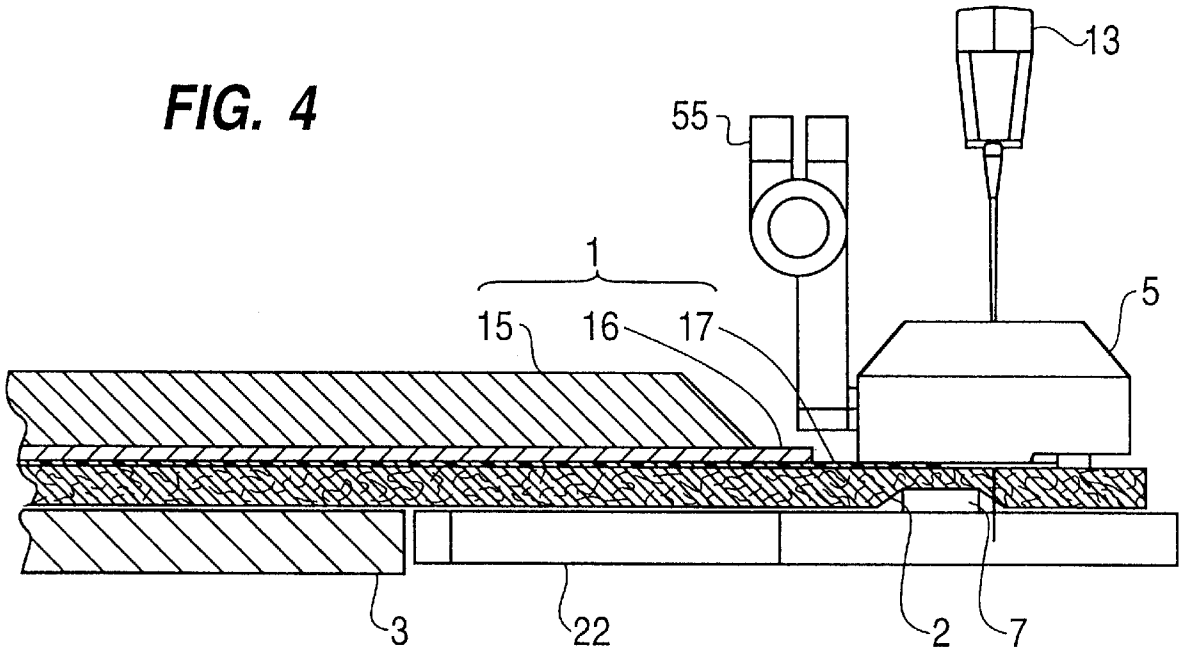
FIG. 4 is a side elevational view showing the partial sectional view (enlarged) of the stitching clamp area with a label clamp assembly according to a first preferred embodiment of the present invention.

Referring to FIG. 4, the workpiece 2 is held to the supporting surface 3 of the table and carried under the presser foot 5 by the stitching clamp assembly 1. The stitching clamp assembly 1 (as shown there) consists of a top plate 15, the extension plate 16, and the flexible membrane 17 in a stacked relationship with the edges of each element being stepped. The workpiece 2 is carried under the presser foot 5 and over the feed dogs 7 where the feed dogs 7 can pull the cloth through, pushing the cloth against the flexible membrane 17 and not against the bottom of the presser foot 7. The presser foot 5 rides in a spaced relationship to the workpiece 2 along the top of a portion of the flexible membrane 17 extending beyond the edge of the extension plate 16.

The flexible membrane 17 is comparatively thin with respect to the top plate 15 and supporting plate 16. In a preferred embodiment, the thickness of the flexible membrane is less than 0.025 inches or, in another embodiment, 0.017 inches. The flexible membrane 17 must be sufficiently pliable to bend in response to pressure exerted by the presser foot 5 against the workpiece 2 for maintaining the workpiece 2 in engagement with the feed dogs 7. This enables the presser foot 5 to vertically move against the membrane 17 during the sewing operation while maintaining the desired downward pressure against the workpiece 2.

The flexible membrane 17 also has a friction resistant surface for supporting the presser foot 5. The flexible membrane 17 creates a barrier between the presser foot 5 and the workpiece 2 that reduces or eliminates the problems of friction discussed above without affecting the normal operation of the combination of the presser foot 5 and feed dogs 7 while drawing the workpiece through the sewing head 6. The flexible membrane 17 extends into an area between the presser foot 5 and the feed dogs 7 for separating the two elements without interfering with normal operation of the needle 13. As shown in the figure, the edge of the flexible membrane 17 terminates prior to entering an area under the presser foot occupied by the path of the reciprocating needle 13 as it executes a stitch. The friction resistant surface allows the presser foot 5 to glide along the top surface of the membrane without grabbing or catching on the workpiece 2. To achieve this property, a preferred embodiment of the flexible membrane 17 is made from a poly-arimid cloth coated with polytraflouroethylene, i.e., Teflon-coated Kevlar® or glass cloth. Other materials having similar properties may be used.

FIG. 4 also illustrates how the combination of the beveled edge of the top plate 15 and small thickness of the extension plate 16 is capable of extending close to the presser foot 5 for maintaining maximum control over the workpiece edge 2 without interfering with the presser foot bracket 55.

Figure 5:
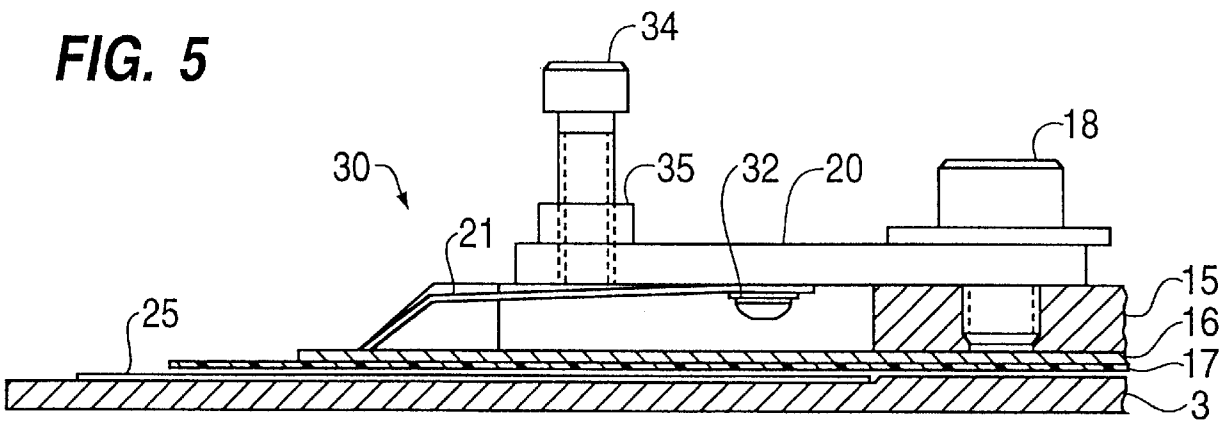
FIG. 5 is an illustration of an automatically sewn washcloth using the stitch clamping mechanism according to a preferred embodiment of the present invention.

Referring to FIG. 5, the details of a label clamp is shown. The stitching clamp assembly 1 with a top plate 15, the extension plate 16 and the flexible membrane 17 are stacked such that the outer edges are stepped. Fastened to the stitching clamp assembly 1 by a screw and a washer 18 to the top plate 15 and extending into the stepped area between the top plate 15 and the extension plate 16 is the label clamp assembly 30. The label clamp assembly 30 consists of a subplate 20 in which a label spring 21 is fastened by screws and washers 32. Inserted in the subplate 20 is a pressure adjusting screw 34 which is locked in place by nut 35. By turning the adjustment screw 34, the pressure on the label spring 21 can be increased or decreased as necessary to hold the label 25 in place. With the label 25 being held by the label spring 21 in position under the flexible membrane 17, the possibility of interference from the presser foot 5 passing over the label 25 is eliminated.

Figure 6:
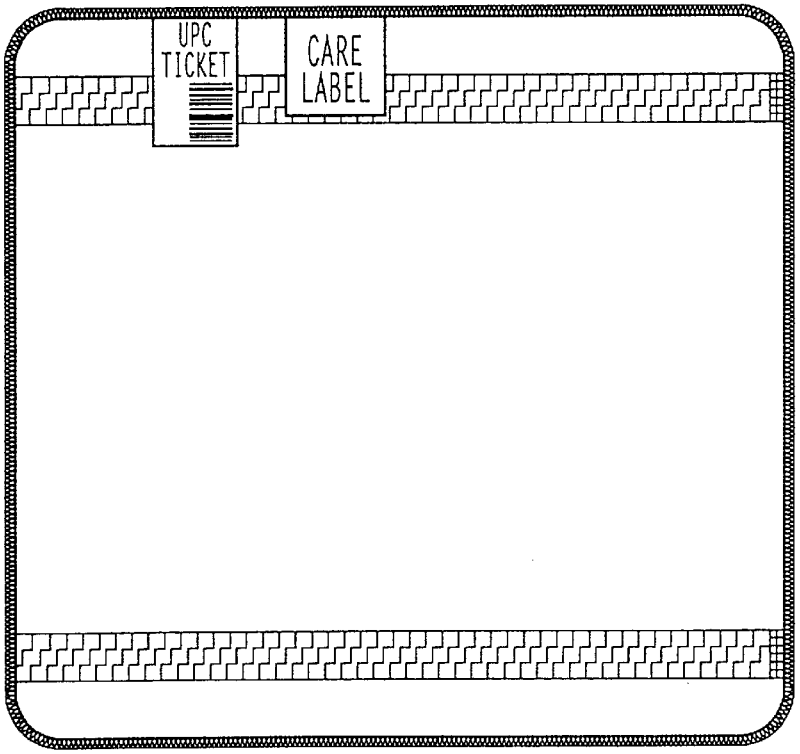
FIG. 6 shows a finished workpiece produced in accordance with the present invention.
Figure 7:
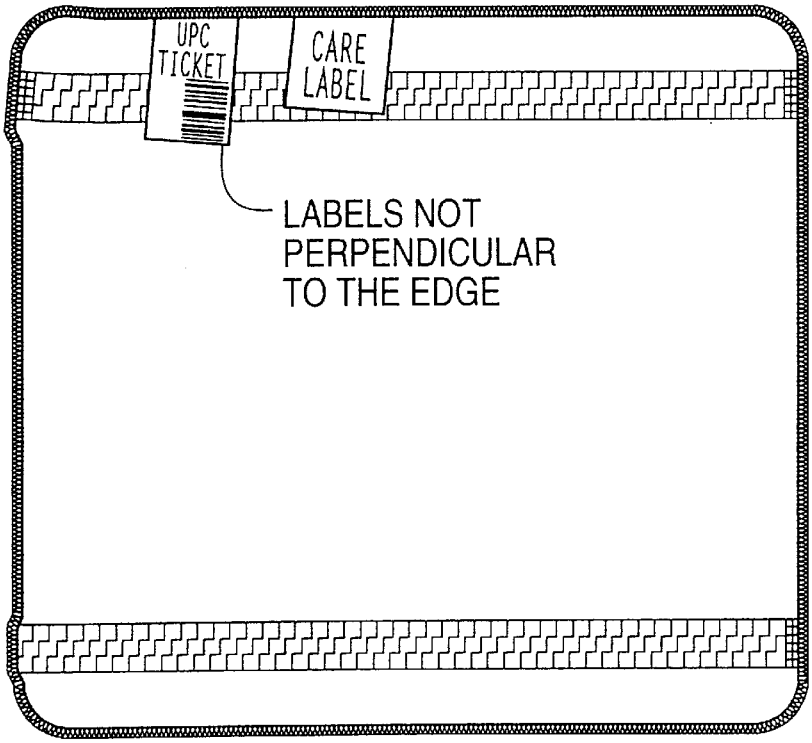
FIG. 7 show a finished workpiece with having a irregular hem and misaligned labels produced using a conventional stitching clamp.

A comparison of FIGS. 6 and 7 illustrate the difference in quality between the finished product when using a conventional stitching clamp design and the disclosed invention.

As shown in FIG. 7, the quality of the washcloth produced using the old extension clamp design illustrates the errors associated with conventional clamping systems. Frequently, the conventional clamping systems yielded product with irregular hems and misaligned labels. It was also difficult to achieve and repeat the quality of the product shown in FIG. 7 with different size workpieces, designs or various thicknesses of material. Frequently, as the cloth changed, a new program would require modification of the velocity profiles and X-Y coordinances for the stitching clamp in order to maintain the desired quality. These problems are eliminated by the apparatus and method disclosed herein as shown in FIG. 6.

Having described the component parts, operation of the apparatus will be described with reference to FIGS. 1–5.

A workpiece is first straightened, lightly tensioned and cut to length. At the same time, if required, labels 25 are inserted under the label clamp assemblies 12 along one side of the workpiece as shown in FIGS. 1 and 5.

The stitching clamp assembly 1 is then positioned by a servocontrol for holding the workpiece 2 against the supporting surface 3 of the work table. The flexible membrane 17 is positioned so that a portion of the workpiece extends beyond the outer edge of the flexible membrane 17. Also, a portion of the flexible membrane 17 extends beyond the outer edge of the extension plate 16. The workpiece and labels are then transported by the servocontrol under the stitching clamp to the sewing head where the overedge hem is produced.

Before the leading edge of the clamped workpiece enters the sewing head 6, air currents A from the blower 19 uncurl and flatten one corner of the workpiece. This ensures that the beginning edge of the hem is straight.

The sewing head 6 engages the workpiece 2 along one side of a corner of the clamped workpiece 2 as shown in FIG. 1. The workpiece 2 is positioned between the feed dogs 7 and presser foot 5 with the flexible membrane 17 positioned therebetween. The presser foot 5 is lowered to be in contact with the flexible membrane 17 that, in turn, presses the workpiece 2 into engagement with the feed dogs 7.

The feed dogs 7 and stitching clamp 1 unilaterally move the workpiece 2 through the sewing head 6 stitch-by-stitch to create the hemmed edge. As the edge of the workpiece enters the sewing head 6 it is folder over by the folder. The folded edge then moves through the sewing head 6 and under the needle 13 where the stitching occurs to create the continuous hem.

During the hemming process, the presser foot 5 rides along the friction resistant side of the flexible membrane 17 without interference from the top plate 15 or extension plate 16.

Once the servocontrol guides the workpiece 2 such that the entire edge is hemmed, the finished product is then removed.

As discussed previously, this hem is produced continuously on all four sides and on the four rounded corners.

Notwithstanding the aforementioned preferred embodiment of the present invention, modifications of the invention may be accomplished by one of ordinary skill in the art without departing from the spirit and scope of the invention as recited in the following claims.

We claim the following:

1. A stitching clamp for securely holding a workpiece with a fixed outer perimeter on the supporting surface of a work table and for carrying the workpiece through the sewing head of a sewing machine between a presser foot and at least one feed dog under at least one needle, the stitching clamp, comprising:

holding means with first and second faces, the second face directed toward the supporting surface of the work table and having an outer perimeter less than the outer perimeter of the workpiece;

a non-metallic bendable membrane with a first surface attached to the second face of the holding means and a second surface for engaging a workpiece positioned on the supporting surface of the work table for moving it through the sewing head in cooperation with the presser foot and feed dogs; and said membrane having an outer perimeter less than the outer perimeter of the workpiece but greater than the outer perimeter of the second face of the holding means such that a portion of the membrane extends beyond the edge of holding means creating a track for the presser foot that separates the presser foot from the workpiece as the at least one feed dog advances the edge of the workpiece through the sewing head without interfering with operation of the at least one needle, the membrane being sufficiently pliable to allow the presser foot maintain contact between the at least one feed dog and workpiece by applying pressure through the membrane.

2. A stitching clamp as recited in claim 1, wherein the flexible is sufficiently thin to maintain the presser foot in a spaced relationship with respect to a workpiece while allowing the presser foot to maintain the workpiece in engagement with the at least one feed dog.

3. A stitching clamp as recited in claim 2, wherein the flexible is less than 0.025 inches in thickness.

4. The stitching clamp as recited in claim 3, wherein the flexible is 0.017 inches in thickness.

5. A stitching clamp as recited in claim 1, wherein the track of the flexible is friction resistant.

6. The stitching clamp as recited in claim 5, wherein the track of the membrane is coated with a polytraflouroethylene.

7. The stitching clamp as recited in claim 1, wherein the membrane is a poly-arimid cloth.

8. The stitching clamp as recited in claim 7 wherein the track of the membrane is coated with a polytraflouroethylene.

9. The stitching clamp as recited in claim 1, wherein the membrane is made of glass cloth.

10. A stitching clamp as recited in claim 1, further comprising means for positioning a leading edge of the workpiece prior to entering the sewing head to insure that the leading edge of the workpiece is not curled before beginning a sewing operation.

11. A stitching clamp as recited in claim 10, said positioning means comprises blower means, positioned on the first face of the holding means, for directing at least one current of air toward the edge of a workpiece held by membrane against the supporting surface for ensuring that the leading edge of the workpiece is uncurled and flatly positioned with respect to the supporting surface of the work table before it is moved through the sewing head.

12. The stitching clamp as recited in claim 11, wherein: said holding means and membrane have rectangular shaped edges, and said blower is positioned adjacent to one of a plurality of comers of the top plate on its first face for directing a current of air toward the leading edge of a workpiece positioned between the flexible membrane and the supporting surface of the work table.

13. A stitching clamp as recited in claim 12, wherein said blower further comprises means for directing a plurality of air currents to at least two sides of the outer edge of the top plate for ensuring that the leading edge of a workpiece is flatly disposed against the supporting surface of the work table.

14. A stitching clamp as recited in claim 1, wherein the first face of the holding means has a beveled edge about the entirety of its outer perimeter.

15. A stitching clamp as recited in claim 12, wherein the rectangular shape Membrane and holding means have rounded corners.

16. A stitching clamp as recited in claim 1, further comprising means mounted on the first surface of the holding means for securing a label against the workpiece in a predetermined position near the outer perimeter of the workpiece.

17. A stitching clamp as recited in claim 15, said label clamping means further comprising pressure adjusting means for controlling a pressure applied against the membrane for securing the label against the workpiece.

18. A method of automatically hemming a workpiece using a stitching clamp, the steps of the method comprising:

clamping a workpiece against a supporting surface with a stitching clamp having a membrane;

moving the clamped workpiece through a sewing head having at least one needle, a presser foot and at least one feed dog for hemming the edge of the workpiece; and wherein in said moving step, positioning a portion of the membrane between the presser foot, the workpiece and the at least one feed dog;

urging the presser foot against the membrane to hold the workpiece in engagement with the at least one feed dog while moving the workpiece through the sewing head.

19. A method as recited in claim 18, further comprising;

prior to said moving step, uncurling a leading edge of the workpiece by directing air currents toward the workpiece and away from the stitching clamp.

20. A stitching clamp as recited in claim 1, wherein said holding means comprising:

a top plate having said first face; and a plate extension attached to said top plate having said second face for supporting the membrane between the workpiece and the presser foot without interfering with the sewing head.

21. A stitching clamp as recited in claim 20, wherein:

said plate extension and membrane have rectangular shaped edges.

22. A stitching clamp as recited in claim 20, wherein the first face of the top plate has a beveled edge about the entirety of its outer perimeter.

23. A stitching clamp as recited in claim 20, wherein said plate extension and membrane have rounded comers.

24. A stitching clamp as recited in claim 20, wherein:

the plate extension having an outer perimeter less than the outer perimeter of the membrane, and greater than an outer perimeter of the top plate.

25. A stitching clamp as recited in claim 20, wherein said plate extension having a thickness less than a thickness of the top plate.

26. An automatic sewing system for securely holding a workpiece with a fixed outer perimeter on the supporting surface of a work table, the system comprising:

a sewing machine having a presser foot and at least one feed dog under at least one needle;

holding means with first and second faces, the second face directed toward the supporting surface of the work table and having an outer perimeter less than the outer perimeter of the workpiece;

a flexible membrane with a first surface attached to the second face of the holding means and a second surface for engaging a workpiece positioned on the supporting surface of the work table for moving it through the sewing head in cooperation with the presser foot and at least one feed dog; and said flexible membrane having an outer perimeter less than the outer perimeter of the workpiece but greater than the outer perimeter of the second face of the holding means such that a portion of the flexible membrane extends beyond the edge of holding means creating a track for the presser foot that separates the presser foot from the workpiece as the at least one feed dog advances the edge of the workpiece through the sewing head without interfering with operation of the at least one needle, the flexible membrane being sufficiently pliable to allow the presser foot to maintain contact between the at least one feed dog and workpiece by applying pressure through the membrane.

* * * * *